US008465119B2

(12) United States Patent
Kuroda

(10) Patent No.: US 8,465,119 B2
(45) Date of Patent: Jun. 18, 2013

(54) CLEANING CONTROL METHOD FOR A FLUID EJECTION HEAD, AND A FLUID EJECTION DEVICE

(75) Inventor: Kiyomi Kuroda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 138 days.

(21) Appl. No.: 13/018,834

(22) Filed: Feb. 1, 2011

(65) Prior Publication Data

US 2011/0199426 A1 Aug. 18, 2011

(30) Foreign Application Priority Data

Feb. 16, 2010 (JP) ..... 2010-030992

(51) Int. Cl.
*B41J 29/393* (2006.01)

(52) U.S. Cl.
USPC ..... 347/19; 347/30

(58) Field of Classification Search
USPC ..... 347/19, 30, 33, 22, 23
See application file for complete search history.

(56) References Cited

U.S. PATENT DOCUMENTS

| | | | | |
|---|---|---|---|---|
| 7,517,044 | B2 * | 4/2009 | Suzuki et al. | 347/22 |
| 2005/0195236 | A1 | 9/2005 | Suzuki et al. | |
| 2009/0073201 | A1 | 3/2009 | Watanabe et al. | |
| 2009/0225128 | A1 | 9/2009 | Kuroda et al. | |

FOREIGN PATENT DOCUMENTS

| | | |
|---|---|---|
| JP | 2008-188840 | 8/2008 |
| JP | 2009-078544 | 4/2009 |
| JP | 2009-208420 | 9/2009 |

* cited by examiner

*Primary Examiner* — Lamson Nguyen

(57) ABSTRACT

A cleaning control method accurately detects the nozzle recovery condition after cleaning and efficiently eliminates ejection problems. When a regular cleaning command is received from a host device 31, the inkjet printer 1 applies an ink suction operation to the inkjet head 13 as a first cleaning step. After the ink suction operation ends, a nozzle check is performed after waiting a delay time T. If a faulty nozzle is detected, a second ink suction operation is performed, the delay time T is waited, and the nozzle check is then run again. The ink suction operation, waiting delay time T, and nozzle check repeat during regular cleaning until the number of faulty nozzles is less than or equal to a reference number, or the nozzle check has been performed a maximum number of times. Each delay time T is set according to the suction strength in the ink suction operation.

11 Claims, 7 Drawing Sheets

CLEANING CONTROL METHOD FOR A FLUID EJECTION HEAD, AND A FLUID EJECTION DEVICE

CROSS-REFERENCE TO RELATED APPLICATION

Japanese Patent Application No. 2010-030992 filed on Feb. 16, 2010 is hereby incorporated by reference in its entirety.

BACKGROUND

1. Technical Field

The present invention relates to a fluid ejection device and to a cleaning control method for recovering a fluid ejection head such as an inkjet head from a faulty fluid ejection state, and relates more particularly to a fluid ejection device and a cleaning control method that run a nozzle check to determine the recovery condition of the nozzles after cleaning.

2. Related Art

The nozzles of an inkjet head used in an inkjet printer can become clogged as a result of bubbles or an increase in the viscosity of ink or other fluid droplets inside the nozzles, or the adherence of foreign matter, resulting in the clogged nozzles being unable to eject fluid droplets. Nozzles may also become partially clogged so that a sufficient volume of ink cannot be ejected. Because print quality will drop if printing is attempted using an inkjet head that has nozzles that are not ejecting correctly (referred to below as "faulty nozzles"), cleaning is required at a regular interval or specific time to restore any faulty nozzles to normal operation.

Japanese Unexamined Patent Appl. Pub. JP-A-2009-208420 teaches an inkjet printer that executes a nozzle check to determine if any nozzles of an inkjet head are faulty, and then runs a cleaning process based on the result of this nozzle check. After cleaning the nozzles based on the result of the nozzle check and the number of faulty nozzles, the inkjet printer described in JP-A-2009-208420 confirms if the nozzles were recovered from the deficient discharge state by running the nozzle check again. If a faulty nozzle is detected, cleaning is repeated, and this process may repeat to a maximum four cleaning operations.

The cleaning operation in JP-A-2009-208420 may be accomplished by an ink suction operation that caps the nozzle surface with a head cap to create a sealed space and then applies suction to this closed space to produce negative pressure around the nozzles and draw ink from the nozzles; a flushing operation that discharges ink from the nozzles in a non-printing operation; or a wiping process that mechanically wipes the nozzle surface with a wiper blade, for example.

When an ink suction operation is used as the cleaning operation, ink continues to flow through the ink supply path and the inkjet head to the nozzle side for some time after cleaning ends, and bubbles contained in the ink may be pulled again to the nozzle side, thus inducing the formation of a faulty nozzle again (this phenomenon is referred to as "induction" herein). More specifically, new faulty nozzles may be produced in the time it takes for ink flow to stabilize after the ink suction operation ends.

More particularly, if suctioning the closed space starts with the ink supply path for supplying ink to the head choked off by a choke valve mechanism, and the ink supply path is then unchoked and additional suction is applied in a choked suction operation that suddenly suctions ink, bubbles created by this choked suction operation sometimes result in the formation of new faulty nozzles.

When new faulty nozzles may thus be formed by induction after cleaning, the results of a nozzle check performed before the ink flow stabilizes will be imprecise. As a result, the need for cleaning to achieve the print quality required by the user, and the content of the required cleaning operation, cannot be accurately determined.

The printer taught in JP-A-2009-208420 inspects the condition of the nozzles after nozzle cleaning by means of a nozzle check, and cleans again if a faulty nozzle is found. However, JP-A-2009-208420 does not address the actual timing of this nozzle check, and a drop in the accuracy of the nozzle check caused by induction is not considered. As a result, faulty nozzles formed by induction may not be detected by the nozzle check, and the number of faulty nozzles present after cleaning ends cannot be accurately determined. Whether or not cleaning resulted in a complete recovery state in which there is not even a single faulty nozzle cannot be accurately known. Cleaning also cannot be optimally applied to efficiently achieve a recovery condition meeting the user's needs.

SUMMARY

A cleaning control method and fluid ejection device according to the invention enable accurately detecting the recovery condition of the nozzles after the nozzles are cleaned, and thereby enables efficiently achieving the head recovery condition needed by the user.

To solve the foregoing problem, a cleaning control method for a fluid ejection head according to a first aspect of the invention includes steps of: performing a cleaning operation that ejects fluid droplets from each nozzle of a fluid ejection head; performing a nozzle check that inspects the cleaned nozzles for faulty nozzles after waiting a specific delay time after the end of the cleaning operation; and setting the length of the delay time according to the content of the immediately preceding cleaning operation.

The invention can set the timing of the nozzle check step that inspects the cleaned nozzles for faulty nozzles so that even faulty nozzles newly created by the cleaning operation that was just executed can also be detected.

A loss of accuracy in the nozzle check of the cleaned nozzles can therefore be suppressed, and the need for further cleaning and the content of any required cleaning can be appropriately determined based on the result of this nozzle check. As a result, cleaning can be done without wasting ink, and a fluid ejection head recovery state that meets the needs of the user can be efficiently achieved. More specifically, a recovery state in which there is not even a single faulty nozzle can also be achieved.

When the cleaning operation includes a suction operation that forms a sealed space using a capping member around a nozzle surface of the fluid ejection head, and produces negative pressure and suctions fluid from the nozzles by suctioning the sealed space from the capping member side, the invention preferably sets the delay time according to the velocity of the fluid flowing during the suction operation through the fluid supply path that supplies fluid to the fluid ejection head.

When a suction operation is used for the cleaning operation, bubbles may reach the nozzles and create a new faulty nozzle during the time it takes for the flow of fluid to the head to stabilize after suction ends. Our tests showed that the flow of fluid stabilizes in less time when the velocity of the fluid in the fluid supply path during suction is fast, and we discovered that the delay time is best set according to the velocity of the fluid during suction. As a result, the delay time is not set unnecessarily long, and the timing of the nozzle check is not delayed unnecessarily.

When the cleaning operation includes a suction operation as described above, the length of the delay time is preferably set according to at least one of the following: whether there was air suction before the start of the immediately preceding suction operation, the negative pressure during the suction operation, and the suction time of the suction operation.

The flow of fluid during suction varies according to the suction strength, that is, the negative pressure during suction, the suction time, and whether there was any air suction. Air suction as used herein is an operation in which suction is applied to the inside of the capping member when open, that is, without creating a sealed space. If the delay time is set according to these parameters, the delay time can be set according to the induction conditions. As a result, the delay time is not set unnecessarily long, and the timing of the nozzle check is not delayed unnecessarily.

Preferably, the delay time is set as described above when the suction operation is a choked suction operation that starts suction of the sealed space while in a choked state in which the fluid supply path that supplies fluid to the fluid ejection head is closed, and then releases the choke and applies further suction.

If suction starts when the fluid supply path is choked so that negative pressure rises, and the choke is then released so that suction is applied suddenly to the fluid supply path, a powerful ink suction operation that can very effectively eliminate clogged nozzles can be achieved. In addition, because the nozzle check can be delayed until the flow of ink produced by powerful suction stabilizes, a drop in the accuracy of the nozzle check can be suppressed.

A cleaning control method according to another aspect of the invention preferably also has steps of repeating the cleaning step and the nozzle check step up to a preset maximum number of times if the number of faulty nozzles detected in the nozzle check step exceeds a preset reference number; and ending the repeating step if during the repeating step the number of faulty nozzles detected in the nozzle check step is less than or equal to the reference number. This aspect of the invention can efficiently restore the fluid ejection head to a condition meeting the user's needs because the need for cleaning can be determined based on the result of a highly accurate nozzle check.

In another aspect of the invention the cleaning operation starts when a start cleaning command is received during a preset time period. For example, when the operating time of a fluid ejection device having the fluid ejection head is preset, the preset time period is preferably set to a time period in which the repeat step can be completed the maximum number of times before the operating time starts.

With this configuration cleaning can be completed before the fluid ejection device starts operating while assuring the required delay time and the accuracy of the nozzle check. As a result, the fluid ejection head can be restored to a fully recovered state having not even a single faulty nozzle at least before the fluid ejection device starts operating.

Another aspect of the invention is a fluid ejection device that has a fluid ejection head; a cleaning unit that performs a cleaning operation that ejects fluid droplets from each nozzle of the fluid ejection head; a nozzle check unit that performs a nozzle check that inspects the cleaned nozzles for faulty nozzles after waiting a specific delay time after the end of the cleaning operation; and a cleaning control unit that sets the length of the delay time according to the content of the immediately preceding cleaning operation.

Preferably, the cleaning operation includes a suction operation that forms a sealed space using a capping member around a nozzle surface of the fluid ejection head, and suctions fluid from the nozzles by suctioning the sealed space from the capping member side, and the cleaning control unit sets the delay time according to the velocity of the fluid flowing during the suction operation through the fluid supply path that supplies fluid to the fluid ejection head.

Further preferably, the cleaning control unit sets the length of the delay time according to at least one of the following: whether there was air suction before the start of the immediately preceding suction operation, the negative pressure during the suction operation, and the suction time of the suction operation.

Further preferably, the cleaning control unit repeats the cleaning and the nozzle check up to a preset maximum number of times if the number of faulty nozzles detected in the nozzle check exceeds a preset reference number, and ends the cleaning and the nozzle check if the number of faulty nozzles detected by the nozzle check is less than or equal to the reference number.

Cleaning that is efficient and does not waste ink is therefore possible, and the fluid ejection head can be restored to a condition that meets the user's needs. More particularly, a condition in which there is not even a single faulty nozzle can be achieved.

Other objects and attainments together with a fuller understanding of the invention will become apparent and appreciated by referring to the following description and claims taken in conjunction with the accompanying drawings.

DESCRIPTION OF EMBODIMENTS

An inkjet printer and a cleaning control method for an inkjet head according to a preferred embodiment of the invention are described below with reference to the accompanying figures.

Figure 1:
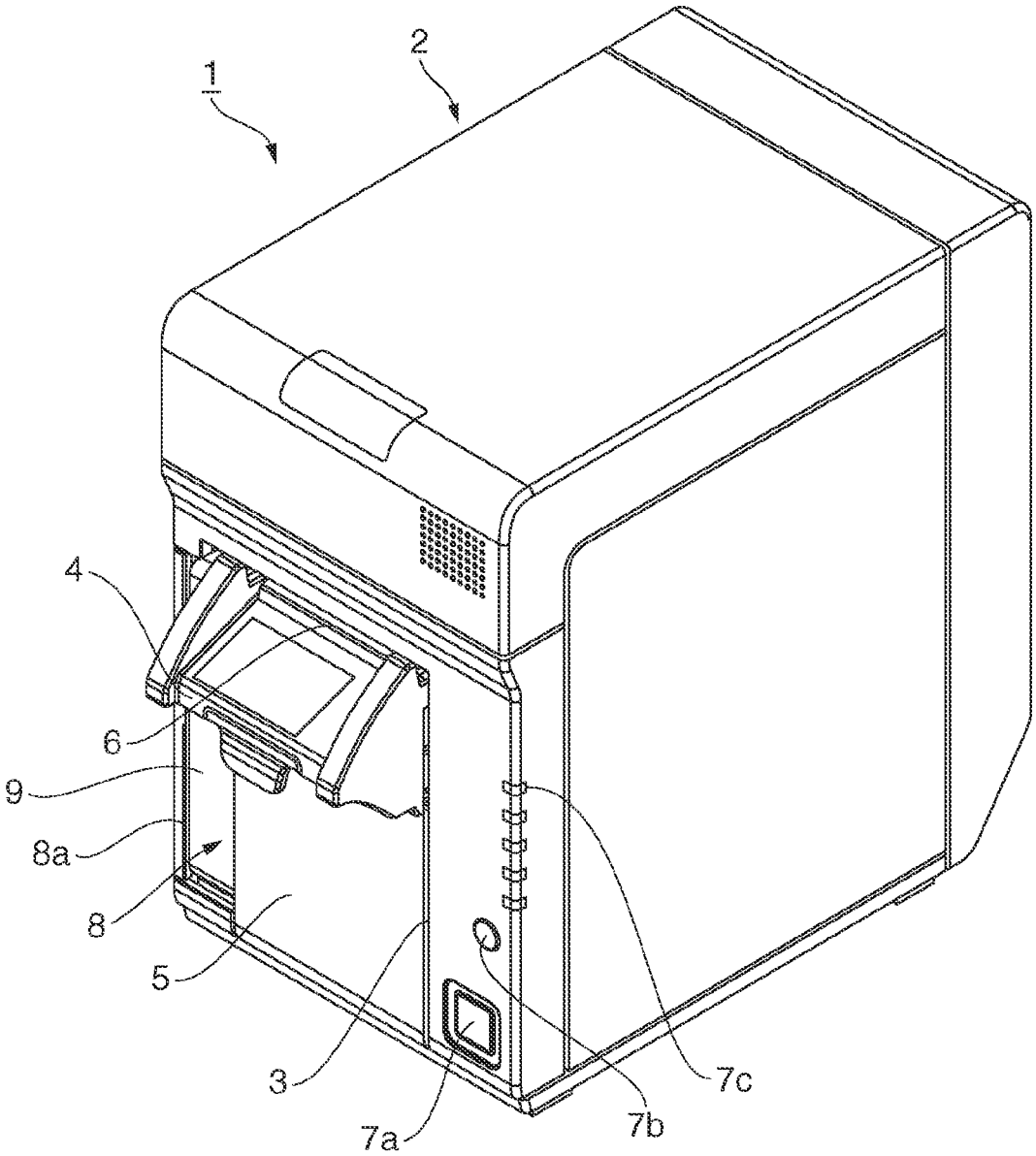
FIG. 1 is an external oblique view of an inkjet printer according to the invention.

FIG. 1 is an external oblique view of an inkjet printer. The inkjet printer 1 (fluid ejection device) prints in color on a continuous web of recording paper delivered from a paper roll using plural different colors of ink, and has a generally box-shaped printer case 2 with an opening 3 for loading roll paper formed in the front center part of the printer case 2. The opening 3 is closed by an access cover 5 to which a recording paper discharge guide 4 is disposed at the top. A recording paper exit 6 is formed between the recording paper discharge guide 4 and the top edge part of the opening 3 in the printer case 2. When a lock mechanism not shown is released and the recording paper discharge guide 4 is pulled forward by hand, the access cover 5 can pivot forward at the bottom end thereof from the closed position shown in the figure to an open position.

A power switch 7*a*, paper feed switch 7*b*, and a plurality of operating status indicators 7*c* are arrayed at the right side of the access cover 5 at the front of the printer case 2. A loading opening 8*a* for an ink cartridge loading unit 8 that is rectangular in section and is disposed with the long side extending in the front-back direction of the printer is formed in the front of the printer case 2 on the left side of the access cover 5, and an ink cartridge 9 is loaded in this ink cartridge loading unit 8. When a button not shown is operated, the lock is released, the ink cartridge 9 is pushed forward by the force of a spring, and the ink cartridge 9 can be removed.

Figure 2:
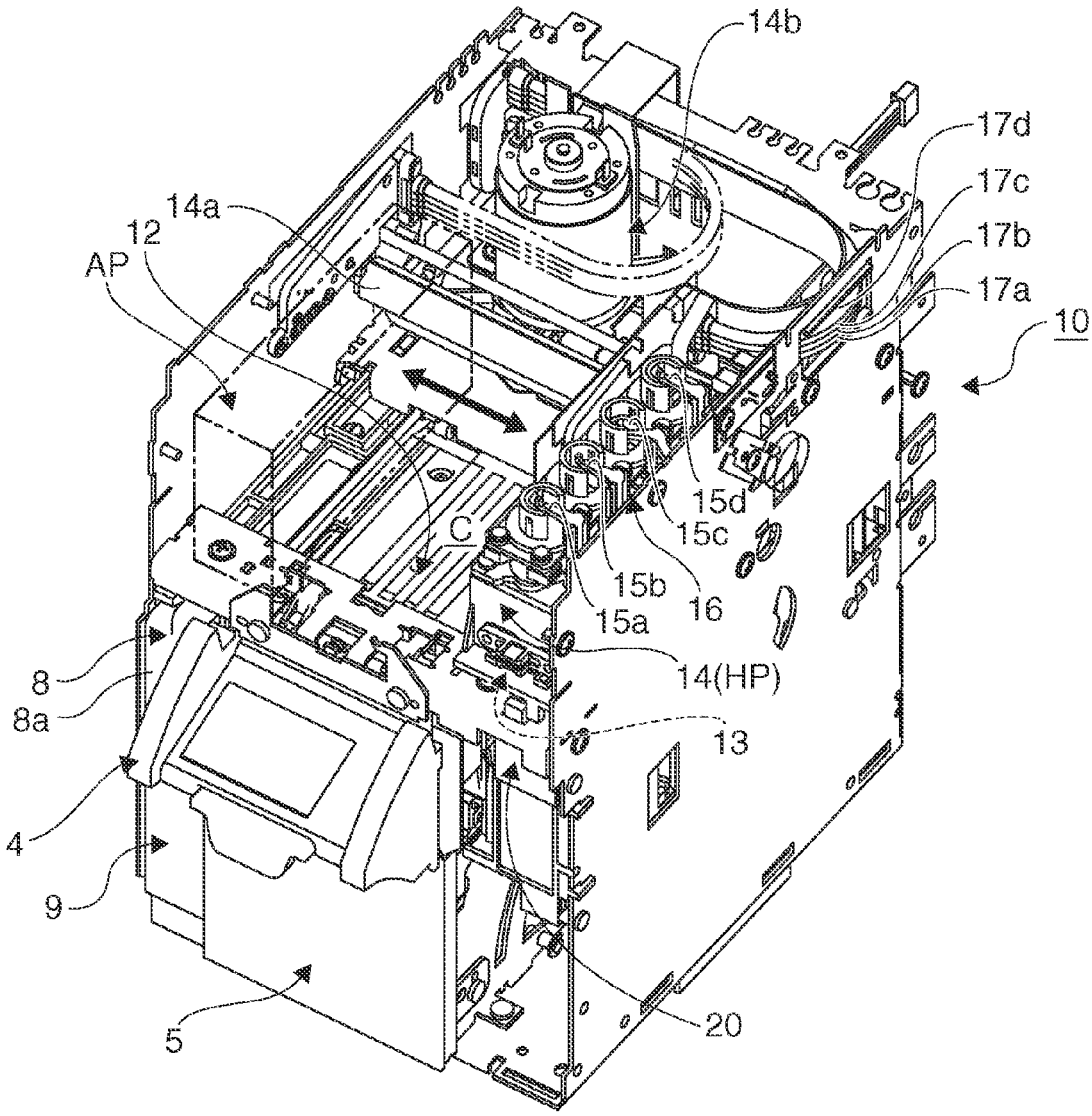
FIG. 2 is a schematic oblique view of the printer mechanism.

FIG. 2 is an oblique view of the print mechanism unit 10 that is covered by the inkjet printer 1 case 2. A roll paper storage compartment is formed inside the print mechanism unit 10 in the center, and when the access cover 5 opens, this roll paper storage compartment opens to the front and the roll paper can be replaced, for example. A platen 12 that defines the printing area extends widthwise to the printer above the roll paper storage compartment.

A carriage 14 on which an inkjet head 13 (fluid ejection head) is mounted with the nozzle surface facing down is disposed above the platen 12. The carriage 14 moves bidirectionally between a home position HP (the position indicated by a solid line in FIG. 2) that is removed to the right from the platen 12, and an away position AP (the position indicated by the imaginary line in FIG. 2) removed to the left side of the platen 12.

Ink Supply System

Figure 3:
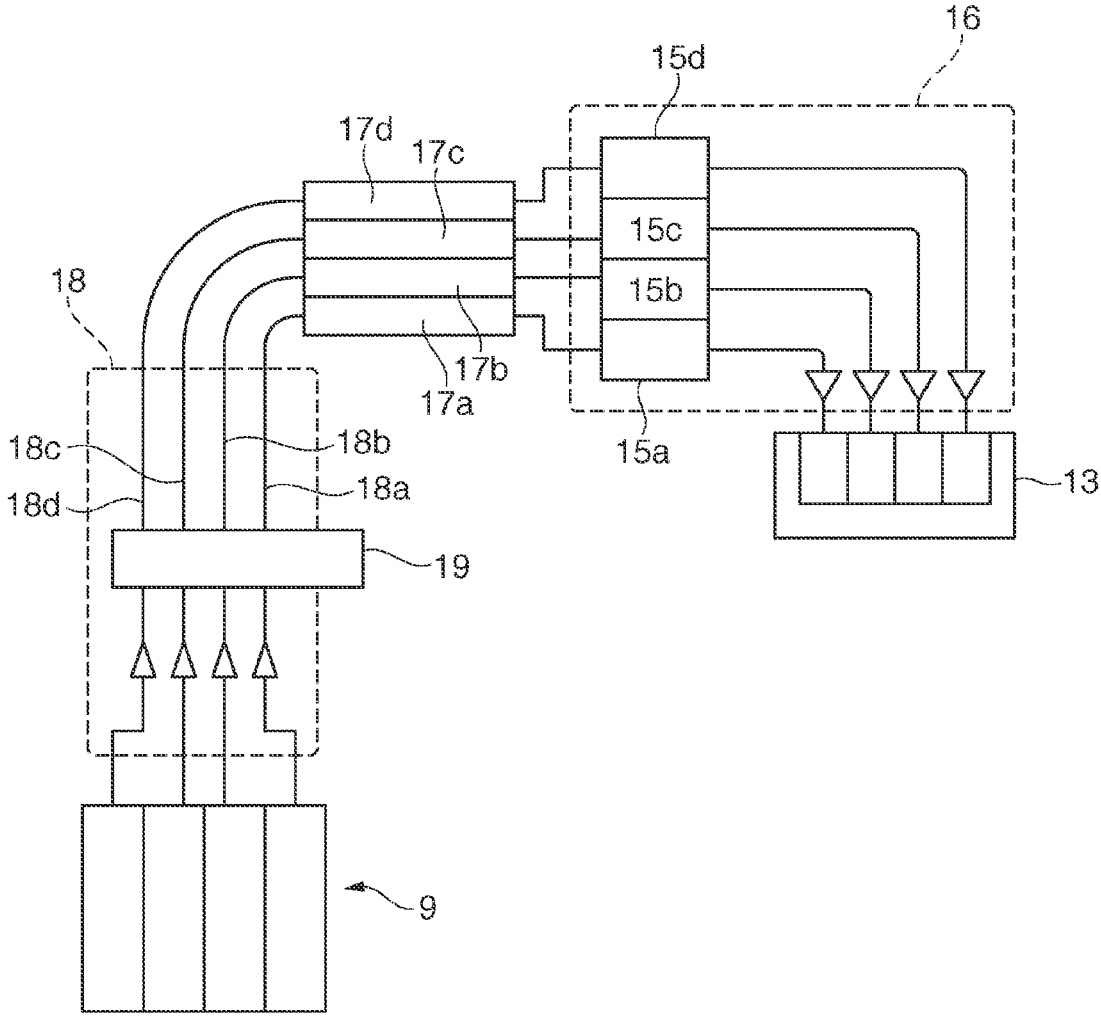
FIG. 3 schematically describes the ink supply system of the inkjet printer.
Figure 4:
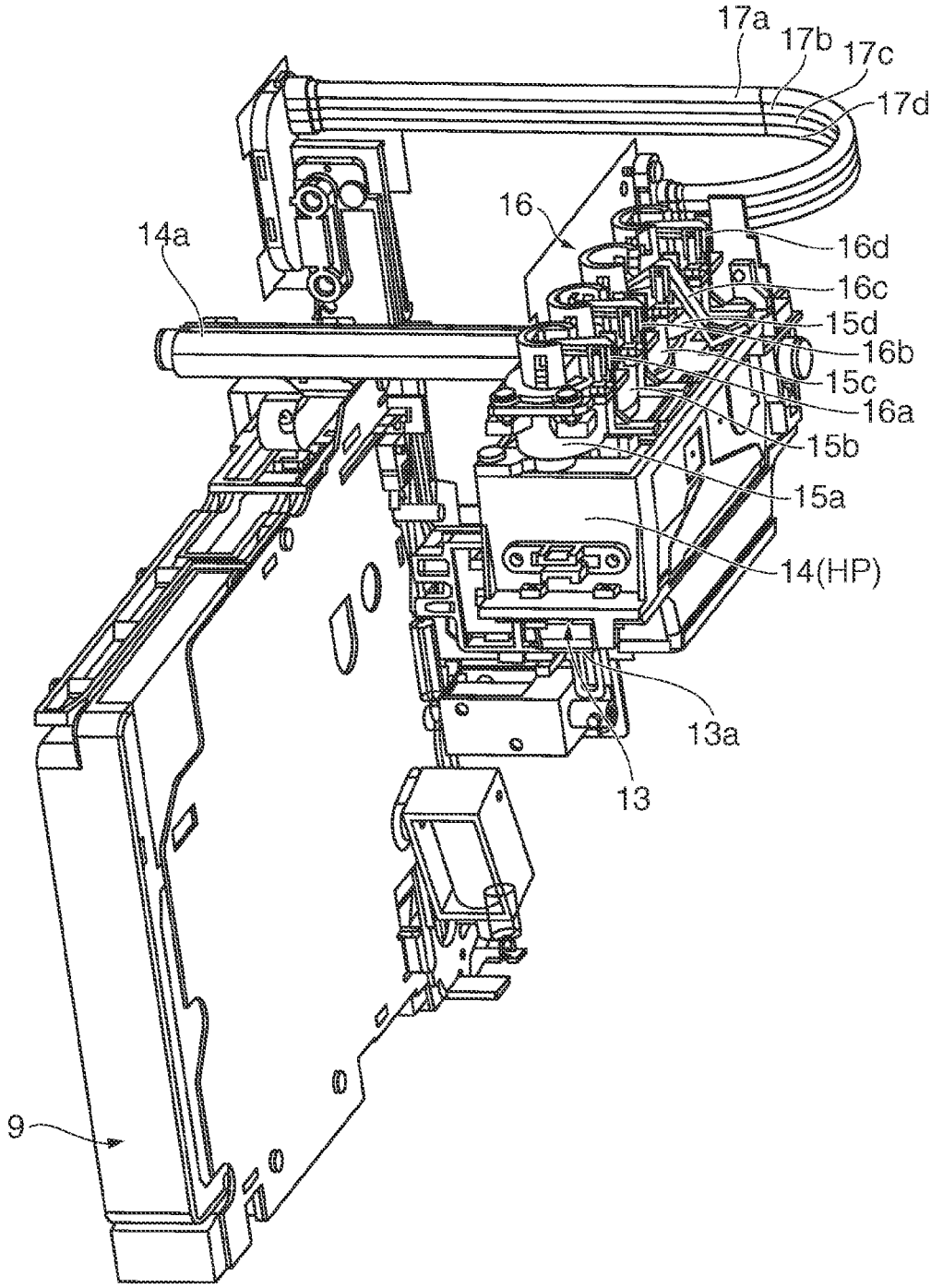
FIG. 4 is an oblique view of the carriage and ink supply system.

FIG. 3 schematically describes the configuration of the ink supply system of the inkjet printer. FIG. 4 is Ink Supply System FIG. 3 schematically describes the configuration of the ink supply system of the inkjet printer 1, and FIG. 4 is an oblique view of the carriage and the ink supply system in the print mechanism unit shown in FIG. 2.

A diaphragm pump unit 16 is disposed to the carriage 14. The diaphragm pump unit 16 has subtanks 15*a* to 15*d* (fluid storage units) in which four colors of ink, cyan, magenta, yellow, and black, are stored.

As shown in FIG. 4, the diaphragm pump unit 16 has suction levers 16*a* to 16*d* attached rockably to the top part of the subtanks 15*a* to 15*d*. One end of each suction lever 16*a* to 16*d* is disposed on the home position HP side of the diaphragm pump unit 16, and the other end is linked by a spring to the diaphragm of each subtank 15*a* to 15*d*.

One end of each flexible ink tube 17*a* to 17*d* is connected to a corresponding subtank 15*a* to 15*d*, and the other end of each flexible ink tube 17*a* to 17*d* is connected to one of the four ink supply paths (not shown in the figure) that extend vertically at a position on the back side of the ink cartridge loading unit 8. A choke valve mechanism 19 is disposed to each ink supply path 18*a* to 18*d*.

The choke valve mechanism 19 has an ink channel, which is a flexible flow path, and a pressure unit that applies pressure to and opens and closes the ink channel, and can vary the section area of each ink channel and change the ink flow. Each of the ink supply paths 18*a* to 18*d* communicates with an ink cartridge 9 loaded in the ink cartridge loading unit 8.

When the carriage 14 returns to the home position HP, one end of each suction lever 16*a* to 16*d* is pushed by the inside wall of the printer case 2 and rocks. As a result, the diaphragm connected to the other end of the suction lever 16*a* to 16*d* works and produces negative pressure in the subtanks 15*a* to 15*d*. Ink is pulled from the flexible ink tube 17*a* to 17*d* side into each subtank by this negative pressure. The ink stored in the subtanks 15*a* to 15*d* is supplied to the ink paths in the inkjet head 13.

Head Maintenance Unit

Figure 5:
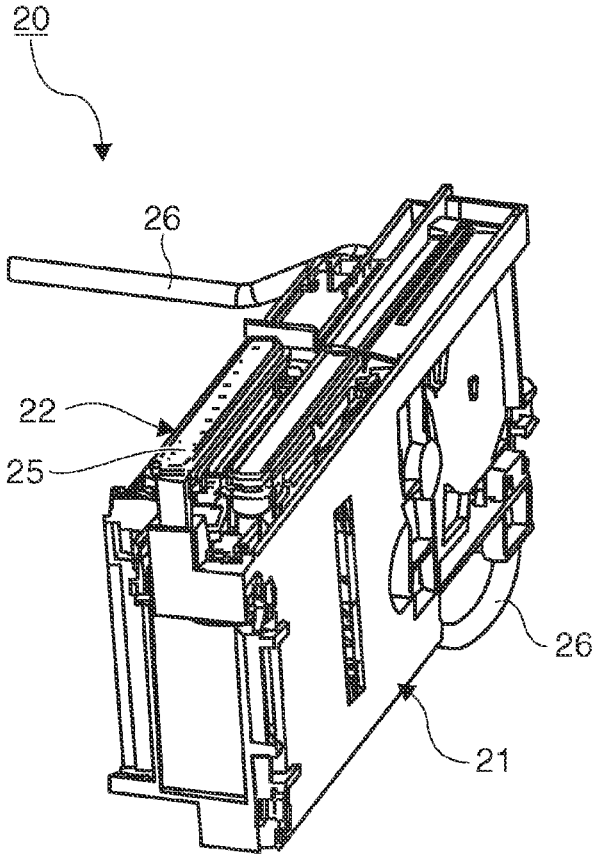
FIG. 5 is an oblique view of the head maintenance unit.

FIG. 5 is an oblique view of the head maintenance unit. The head maintenance unit 20 is disposed at a position below the home position HP of the carriage 40. The head maintenance unit 20 has a unit case 21 with a narrow rectangular shape that is long in the front-back direction of the printer. A head cap 22 for capping the nozzle surface 13*a* of the inkjet head 13 is disposed at the front top part of this unit case 21. A head cap lift mechanism (not shown in the figure) is rendered below the head cap 22.

Figure 6:
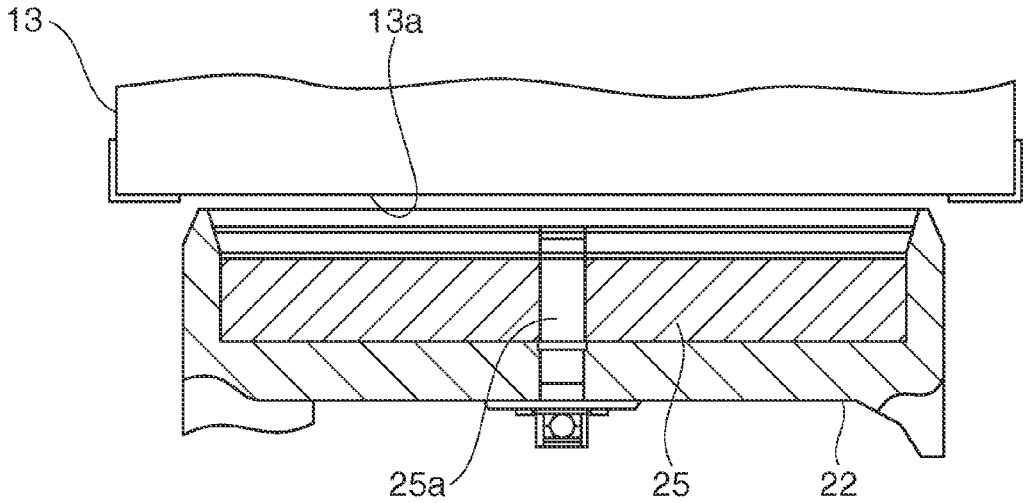
FIG. 6 is a partial section view of the head cap and inkjet head.

FIG. 6 is a partial section view of the head cap and inkjet head when directly opposite each other. As shown in the figure, the head cap 22 is rectangular in section and is open to the top. When the carriage 14 is at the home position HP and the head cap 22 is raised, the nozzle surface 13*a* of the inkjet head 13 is capped from below by the head cap 22.

An ink sponge 25 is held in the bottom of the head cap 22, and a conductor 25*a* that electrically communicates with the ink sponge 25 is attached. The electrical signal flowing through the conductor 25*a* is extracted by wire, for example, and input to a control unit 30 described below (see FIG. 7). When charged ink is ejected from the nozzles in the nozzle surface 13*a* opposite the head cap 22, signals indicating the current change that is produced when the discharged ink droplets land on the ink sponge 25 can be extracted. If this signal is below a specified threshold value even though ink was discharged from the nozzle, a nozzle ejection defect can be detected.

When performing this nozzle check to detect the locations and number of faulty nozzles in the nozzle surface 13*a* based on the electrical signals flowing through the conductor 25*a*, the head cap 22 is positioned so that the gap between the ink sponge 25 and the nozzle surface 13*a* is a specific size, and voltage is then applied so that the potential difference of the inkjet head 13 and head cap 22 goes to a specific threshold value or greater. As a result, the ink droplet ejection state can be accurately detected.

A tube pump 27 (see FIG. 7) and waste ink tube 26 are connected to the head cap 22. The tube pump 27 is disposed at the back of the unit case 21. Waste ink discharged or suctioned into the head cap 22 is held in the ink sponge 25. By driving the tube pump 27, the waste ink is recovered through the waste ink tube 26 into a waste ink holding unit inside the ink cartridge 9 loaded in the ink cartridge loading unit 8.

The head maintenance unit 20 can execute a flushing operation that caps the nozzle surface 13*a* with the head cap 22 and discharges ink droplets outside of a printing operation as a cleaning operation to eliminate faulty nozzles. An ink suction operation that suctions and removes ink from the nozzles of the capped nozzle surface 13*a* by driving the tube pump when the nozzle surface 13*a* is capped can also be used as the cleaning operation. When the ink suction operation is used, the tube pump 27 is driven for a specified time with the ink supply paths 18*a* to 18*d* choked off by the choke valve mechanism 19 to increase the negative pressure on the ink path downstream, the choke valve mechanism 19 is then fully opened and the ink supply paths 18*a* to 18*d* unchoked, and further suction is applied to abruptly suck ink from the nozzles.

Control System

Figure 7:
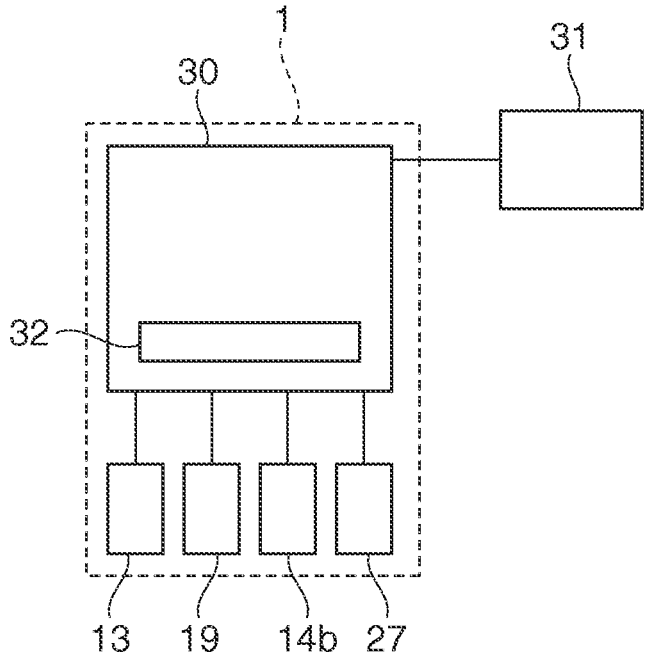
FIG. 7 is a block diagram showing the control system of the inkjet printer.

FIG. 7 is a block diagram showing the control system of the inkjet printer. The control system of the inkjet printer 1 is built around a control unit 30 that includes a CPU and storage such as ROM and RAM. The control unit 30 is connected to a host device 31, for example, and controls other parts of the inkjet printer 1 based on print data and commands received from the host device 31.

Based on the received print data, the control unit 30 drives a recording paper transportation mechanism not shown and conveys the recording paper delivered from a paper roll over the surface of the platen 12. The control unit 30 also prints on the recording paper by driving the carriage drive mechanism 14*b* in conjunction with recording paper transportation to move the carriage 14 across the paper while ejecting ink from the inkjet head 13 onto the recording paper.

When printing ends, the control unit 30 moves the carriage 14 to the home position HP. The control unit 30 also raises the head cap 22 to cap the inkjet head 13, and then waits.

The control unit 30 includes a cleaning control unit 32. The cleaning control unit 32 can execute an ink suction operation by means of a choke and suction operation as the cleaning operation. The cleaning operation could consist of the ink suction operation or flushing, or a combination of both. Alternatively, a combination of flushing, ink suction, and a wiping operation that wipes the nozzle surface 13*a* by means of a wiper blade slidably supported on the frame of the head maintenance unit 20 is also conceivable.

Based on a command such as a regular cleaning command described below, the cleaning control unit 32 executes the cleaning operation specified in the command. Alternatively, when preset cleaning conditions are met, the cleaning control unit 32 may execute a cleaning operation matching the specific cleaning conditions. For example, if a nozzle check is executed to inspect the ejection condition of ink discharged from the nozzles, the need for cleaning may be determined and the cleaning operation executed based on the result of the inspection. By performing the nozzle check after the cleaning operation, the cleaning control unit 32 can also determine if the faulty ejection condition was corrected by the cleaning operation, and whether or not it is necessary to continue cleaning.

A cleaning conditions table is stored in a specific storage area of the control unit 30.

This cleaning conditions table stores the conditions when cleaning is required correlated to the content of the cleaning operation to be performed. For example, the content of the optimal cleaning process may be set according to the number of times a cleaning operation was applied and the results of the immediately preceding nozzle check. In addition, if the print quality and printing speed can be set as a print mode, the content of the optimal cleaning process could be set according to the print mode. Note that the content of the cleaning operation that is applied based on different commands can be set in the cleaning conditions table correlated to the commands, and when a command is received, the cleaning conditions table could be referenced to determine the content of the cleaning process.

When an ink suction operation is executed as the cleaning operation, the cleaning control unit 32 controls the suction strength based on a combination of three parameters, that is, (1) whether there is air suction, (2) the negative pressure when suction is applied, and (3) the suction time. Air suction as used here means that the tube pump 27 is driven while the inside of the head cap 22 is open and exposed to the air to suction ink in the head cap 22 into the waste ink tube 26. The cleaning control unit 32 controls whether or not air suction is applied before the ink suction operation starts.

The cleaning control unit 32 adjusts the negative pressure during suction and the suction time to specified values by appropriately controlling the speed and drive time of the pump motor that drives the tube pump 27, and the ink path blockage time of the choke valve mechanism 19 when suction starts. The suction strength during the ink suction operation is specified by a combination of the above three parameters in the command for executing the cleaning operation or the cleaning conditions table.

Regular Cleaning Control

If a regular cleaning command sent from the host device 31 is received when a print job is not executing, for example, the inkjet printer 1 executes a regular cleaning process for completely restoring all nozzles of the inkjet head 13 by means of an ink suction operation so that there is not even a single faulty nozzle.

Figure 8:
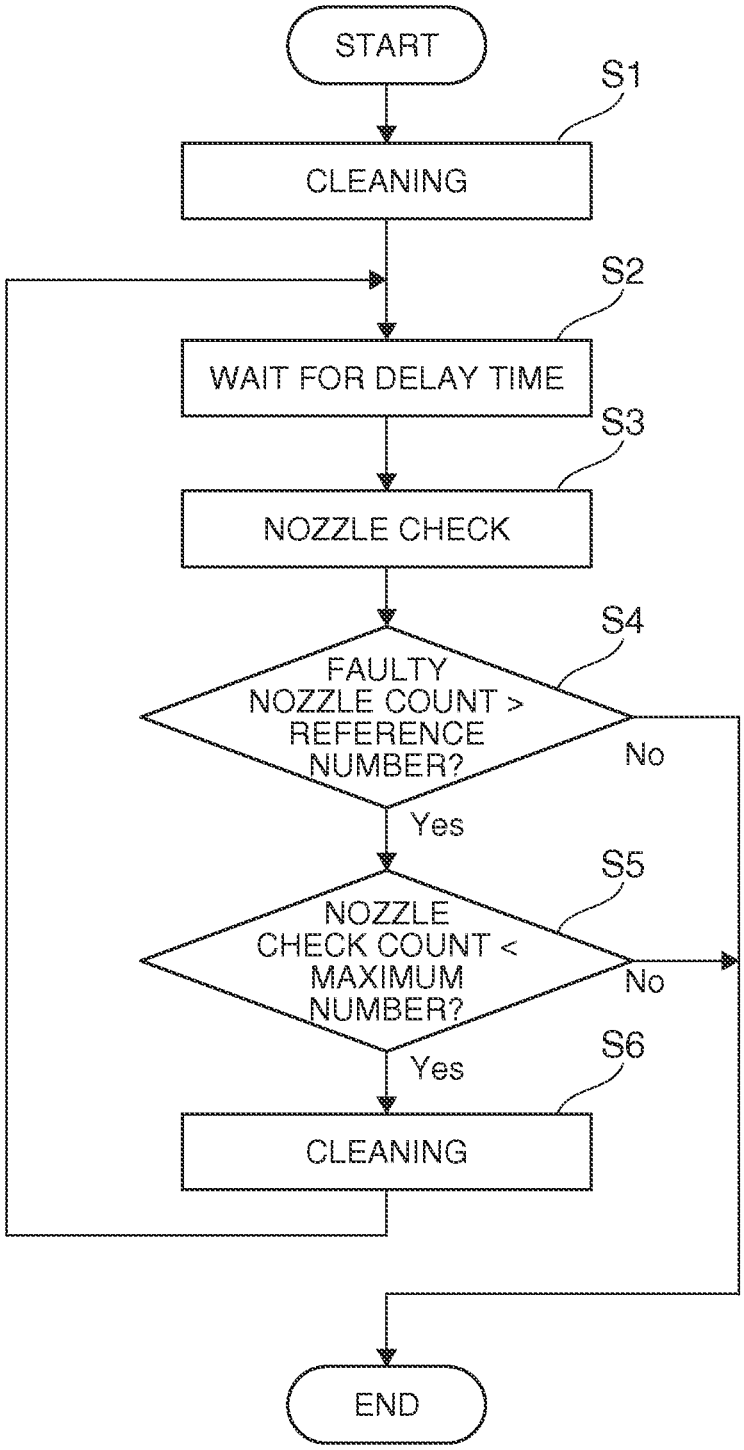
FIG. 8 is a flow chart of the regular cleaning process.

FIG. 8 is a flow chart of the regular cleaning operation.

The host device 31 sends a regular cleaning command to the inkjet printer 1 at a preset time, such as at 12:00 a.m. The host device 31 sends the regular cleaning command at a time when there is sufficient time for the regular cleaning operation to be completed before the start of the normal operating time of the inkjet printer 1, that is, the starting time of the time period when print jobs may be sent to the inkjet printer 1. This timing can be set based on the maximum time required for completion of the regular cleaning operation.

The cleaning control unit 32 starts the process shown in the flow chart in FIG. 8 when this regular cleaning command is received. The cleaning control unit 32 first executes a cleaning operation of predefined content (a first cleaning step) in step S1. In this embodiment of the invention a nozzle check is not performed before the first cleaning step, which is an ink suction operation at a strength specified in the regular cleaning command.

In step S2, the cleaning control unit 32 starts an internal timer of the inkjet printer 1 to count the time from the end of the ink suction operation in the first cleaning operation, and waits without executing a nozzle check until a preset delay time T passes. The cleaning control unit 32 uses a time determined by the content of the cleaning operation executed in the first cleaning step, such as the suction strength of the ink suction operation, as the delay time T. The length of this delay time T following the first cleaning step is set in the regular cleaning command with other parameters setting the suction strength of the cleaning step.

This embodiment of the invention uses the time until induction caused by the immediately preceding ink suction operation ends as the delay time T. As described above, induction occurs when ink in the inkjet head 13 and the ink supply path upstream therefrom continues flowing to the nozzle side for a time after the ink suction operation ends and bubbles contained in the flowing ink may be pulled into a nozzle. The time required for induction to end is therefore the time required for the ink flow to stabilize to a level at which new faulty nozzles will not be created after the ink suction operation ends.

We studied the time required for the ink flow produced by the ink suction operation to stabilize after ink suction at various pressure levels ends, and discovered that if the delay time T is set to 30 minutes ink flow stabilizes reliably after ink suction at any pressure level that could be used.

We also discovered that the time required for ink flow to stabilize differs according to suction strength, and when ink flow during suction is fast, induction ends in less time. The velocity of the ink during ink suction operations at different strengths is therefore determined, and a shorter delay time T is set for higher velocity ink suction operations.

More specifically, the fluid velocity during suction and the time required for induction to end are therefore determined for various combinations of the parameters set in the cleaning conditions table, that is, (1) whether there is air suction, (2)

the negative pressure when suction is applied, and (3) the suction time, and the shortest delay time T required for induction to end is set accordingly for each combination of parameters. Note that the delay time T may also be set using only one or two of these three parameters.

When the cleaning control unit 32 determines in step S2 that the delay time T has passed, it applies a nozzle check to the nozzles that were cleaned and increments a counter that keeps the nozzle check count by 1 in step S3. This counter is reset to zero when the regular cleaning operation starts.

In step S4 the cleaning control unit 32 then evaluates the results of the nozzle check. In this embodiment of the invention the regular cleaning operation ends if the number of faulty nozzles detected in the nozzle check is a preset reference number (such as zero) (step S4 returns No). If the number of faulty nozzles is greater than this reference numeral (such as when only one is detected) (step S4 returns Yes), the cleaning control unit 32 goes to step S5.

In step S5, the cleaning control unit 32 gets the current count of the counter and determines if the number of times the nozzle check already executed during the regular cleaning operation is greater than or equal to a preset maximum count. If the number of nozzle checks is greater than or equal to this maximum count (step S5 returns No), the regular cleaning operation ends. If the number of nozzle checks is less than this maximum count (step S5 returns Yes), control goes to step S6.

In step S6 the cleaning control unit 32 executes a second cleaning operation to recover the detected faulty nozzles based on the result of the immediately preceding nozzle check.

For the second cleaning operation the cleaning conditions table is referenced based on the result of the immediately preceding nozzle check to apply an ink suction operation of optimal strength. The strength of the ink suction operation in the second cleaning operation may alternatively be set in the regular cleaning command.

After step S6, the cleaning control unit 32 returns to step S2 and causes the mechanisms used in the cleaning operation and the nozzle check to wait for a preset time. The cleaning control unit 32 sets the delay time T of this second standby period according to the immediately preceding ink suction operation. More specifically, based on the regular cleaning command, or by referencing the cleaning conditions table, a delay time T determined according to the three parameters that controlled the immediately preceding ink suction operation is set as the second delay time T. When the set delay time T passes, control returns to step S3. Steps S6, S2, and S3 thereafter repeat until the faulty nozzle count is less than or equal to the reference number, or until the nozzle check count reaches the maximum. In this embodiment of the invention the maximum nozzle check count is three. This results in the cleaning operation being executed up to four times in one cleaning process.

As described above, this embodiment of the invention runs a regular cleaning process during a time period when there is sufficient time to complete the cleaning process without interfering with print job execution. This regular cleaning then waits without executing a nozzle check after each cleaning step until induction accompanying the ink suction operation ends, and executes a nozzle check after delay time T passes and induction ends. As a result, the need for additional cleaning can be accurately determined because the nozzle check can detect all faulty nozzles, including faulty nozzles resulting from induction. Furthermore, the content of the next cleaning operation is determined based on the results of an accurate nozzle check, and cleaning can be done efficiently without wasting ink. For example, because the complete absence of any faulty nozzles can be accurately determined after the cleaning operation ends, a complete recovery condition in which there is not even one faulty nozzle can be achieved.

This embodiment of the invention adjusts the length of the delay time T before the nozzle check according to the suction strength of the immediately preceding ink suction operation, that is, the negative pressure during suction, the length of the suction time, and whether there was air suction. Because the delay time T can thus be set according to the induction conditions, the delay time T is not set longer than necessary and the timing of the nozzle check need not be delayed more than necessary. The accuracy of the nozzle check can therefore be maintained while the time required for regular cleaning can be shortened as much as possible.

Other Embodiments

The foregoing embodiment describes an application of the invention to cleaning method for an inkjet printer 1, but the invention can also be applied to a cleaning control method for fluid ejection heads in fluid ejection devices that discharge fluids other than ink. For example, the invention can be applied in fluid ejection devices that discharge reagent solutions or fluid specimens, for example, from a fluid ejection head, and to fluid ejection devices that eject fluid coatings or fluid materials from a fluid ejection head to coat a target by printing.

The foregoing embodiment of the invention describes controlling the regular cleaning of an inkjet head 13 in an inkjet printer 1, but the invention can also be applied to control cleaning at times other than the regular cleaning process. For example, during high quality printing, cleaning could be applied to completely restore all nozzles before printing starts, and during the cleaning process a nozzle check to inspect the recovery state of the cleaned nozzles could be executed after induction due to the immediately preceding ink ejection operation ends. While this takes time, printing can proceed while reliably achieving the nozzle recovery state required for high quality printing. In addition, a command to run this cleaning operation can be sent to the inkjet printer 1 as needed by the user, and a full nozzle recovery state can be achieved when needed.

Variations (1) Regular cleaning starts according to reception of a regular cleaning command in the embodiment described above, but the control program of the cleaning control unit 32 may be written so that regular cleaning starts when an internal clock of the inkjet printer 1 reaches a specific time. In this case the strength of the ink suction operation during each iteration of the cleaning operation, and the length of the corresponding delay time T, are preferably set in the control program.

(2) The foregoing embodiment does not determine the need for cleaning by means of a nozzle check before the first cleaning operation, but the regular cleaning command may be constructed so that a nozzle check is performed before step S1 described above, and the cleaning conditions table is referenced and the first cleaning operation is executed based on the result of the nozzle check.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cleaning control method for a fluid ejection head, comprising steps of:

performing a cleaning operation that ejects fluid droplets from each nozzle of a fluid ejection head;

performing a nozzle check that inspects the cleaned nozzles for faulty nozzles after waiting a specific delay time after the end of the cleaning operation; and setting the length of the delay time according to the content of the immediately preceding cleaning operation.

2. The cleaning control method for a fluid ejection head described in claim 1, wherein:

the cleaning operation includes a suction operation that forms a sealed space using a capping member around a nozzle surface of the fluid ejection head, and suctions fluid from the nozzles by suctioning the sealed space from the capping member side, and sets the delay time according to the velocity of the fluid flowing during the suction operation through the fluid supply path that supplies fluid to the fluid ejection head.

3. The cleaning control method for a fluid ejection head described in claim 1, wherein:

the cleaning operation includes a suction operation that forms a sealed space by using a capping member around a nozzle surface of the fluid ejection head, and produces negative pressure and suctions fluid from the nozzles by suctioning the sealed space from the capping member side; and the length of the delay time is set according to at least one of the following: whether there was air suction before the start of the immediately preceding suction operation, the negative pressure during the suction operation, and the suction time of the suction operation.

4. The cleaning control method for a fluid ejection head described in claim 2, wherein:

the suction operation is a choked suction operation that starts suction of the sealed space while in a choked state in which the fluid supply path that supplies fluid to the fluid ejection head is closed, and then releases the choke and applies further suction.

5. The cleaning control method for a fluid ejection head described in claim 1, further comprising steps of:

repeating the cleaning step and the nozzle check step up to a preset maximum number of times if the number of faulty nozzles detected in the nozzle check step exceeds a preset reference number; and ending the repeating step if during the repeating step the number of faulty nozzles detected in the nozzle check step is less than or equal to the reference number.

6. The cleaning control method for a fluid ejection head described in claim 5, wherein:

the cleaning operation starts when a start cleaning command is received during a preset time period.

7. The cleaning control method for a fluid ejection head described in claim 6, wherein:

an operating time is preset for a fluid ejection device having the fluid ejection head, and the preset time period is a time period in which the repeat step can be completed the maximum number of times before the operating time starts.

8. A fluid ejection device comprising:

a fluid ejection head;

a cleaning unit that performs a cleaning operation that ejects fluid droplets from each nozzle of the fluid ejection head;

a nozzle check unit that performs a nozzle check that inspects the cleaned nozzles for faulty nozzles after waiting a specific delay time after the end of the cleaning operation; and a cleaning control unit that sets the length of the delay time according to the content of the immediately preceding cleaning operation.

9. The fluid ejection device described in claim 8, wherein:

the cleaning operation includes a suction operation that forms a sealed space using a capping member around a nozzle surface of the fluid ejection head, and suctions fluid from the nozzles by suctioning the sealed space from the capping member side, and the cleaning control unit sets the delay time according to the velocity of the fluid flowing during the suction operation through the fluid supply path that supplies fluid to the fluid ejection head.

10. The fluid ejection device described in claim 9, wherein:

the cleaning control unit sets the length of the delay time according to at least one of the following: whether there was air suction before the start of the immediately preceding suction operation, the negative pressure during the suction operation, and the suction time of the suction operation.

11. The fluid ejection device described in claim 8, wherein:

the cleaning control unit repeats the cleaning and the nozzle check up to a preset maximum number of times if the number of faulty nozzles detected in the nozzle check exceeds a preset reference number, and ends the cleaning and the nozzle check if the number of faulty nozzles detected by the nozzle check is less than or equal to the reference number.

* * * * *